US005266733A

United States Patent [19]

Jacobson

[11] Patent Number: 5,266,733

[45] Date of Patent: Nov. 30, 1993

[54] HIGH HAT

[76] Inventor: Lucas A. Jacobson, P.O. Box 115, Grenora, N. Dak. 58845

[21] Appl. No.: 872,593

[22] Filed: Apr. 23, 1992

Related U.S. Application Data

[63] Continuation-in-part of Ser. No. 643,196, Jan. 18, 1991.

[51] Int. Cl.[5] ..... G10D 13/02

[52] U.S. Cl. ..... 84/422.3

[58] Field of Search ..... 84/422.1, 422.2, 422.3

[56] References Cited

U.S. PATENT DOCUMENTS

| | | | |
|---|---|---|---|
| 4,691,613 | 9/1987 | Jacobson | 84/422.1 |
| 4,756,224 | 7/1988 | Lombardi | 84/422.1 |
| 4,905,565 | 3/1990 | Hoshino | 84/422.3 |

*Primary Examiner*—Michael L. Gellner
*Assistant Examiner*—P. J. Stanzione
*Attorney, Agent, or Firm*—Zarley, McKee, Thomte, Voorhees & Sease

[57] ABSTRACT

A high hat includes a ground supported stand with a vertical hollow tube through which a cymbal rod is operably mounted. A lower cymbal is mounted on the upper end of the tube with an upper cymbal connected to the upper end of the cymbal rod such that vertical movement of the cymbal rod will cause the upper and lower cymbals to contact one another for a percussive sound. A spring is connected to the cymbal rod to bias the rod into its upper position, wherein the upper cymbal is spaced upwardly away from the lower cymbal. An operable foot pedal is utilized to move the cymbal rod and cause the upper and lower cymbals to contact one another. The foot pedal includes a foot plate pivotally connected at a heel end to a base. A pair of sprockets are connected together and rotatably mounted on a shaft above the toe end of the foot plate. A first chain extends from the toe end of the foot plate and is wrapped partially around the first sprocket on the shaft and is connected thereto so as to cause the sprocket to rotate when the foot plate is depressed. A second drive chain extends from the lower end of the cymbal rod and is wrapped partially around the second sprocket and is connected thereto so as to lower the cymbal rod when the second sprocket is rotated with the first sprocket upon depressing the foot plate. The first and second sprockets are eccentrically mounted on the shaft and offset from one another such that the ratio of vertical cymbal rod movement to pivotal foot plate movement will vary during the stroke of the foot plate.

2 Claims, 5 Drawing Sheets

HIGH HAT

CROSS-REFERENCE TO RELATED APPLICATION

This is a continuation-in-part application of Ser. No. 07/643,196 filed Jan. 18, 1991.

TECHNICAL FIELD

The present invention relates generally to high hats, and more particularly to a high hat with features for improving the performance of the motion transmitted from the foot pedal to the cymbals.

BACKGROUND OF THE INVENTION

A high hat is a foot operated percussion instrument designed to clash two opposingly mounted cymbals. Conventionally, a lower cymbal is held stationary on a stand, while the upper cymbal is moved into engagement with the lower cymbal by operation of the foot pedal.

Typically, these pedals are pivotable at their heel with the toe end of the pedal connected to a cable or chain extending upwardly into the high hat stand where the cable is connected to a vertical rod. In some versions, the pedal is connected directly to the vertical rod. The vertical rod is connected to the upper cymbal so as to move the cymbal downwardly into engagement with the lower cymbal. A spring connected to the vertical rod will bias the rod upwardly so as to position the upper cymbal in a normally disengaged position.

Prior art high hat foot pedals are generally constructed so that the ratio of the change in foot plate angle to the change in vertical drop of the vertical cymbal rod is constant throughout a single stroke. One example of such a foot pedal is that shown in U.S. Pat. No. 4,905,565 to Hoshino. In that patent, a pair of sprockets are coaxially mounted on a drive shaft with the foot pedal connected to one sprocket and the high hat cymbal rod connected to the other sprocket. By virtue of use of sprockets of different diameters, the ratio of the change in foot plate angle to the change in vertical drop of the cymbal rod is constant throughout a single stroke. This ratio may be changed, but will remain constant, by the utilization of sprockets of different diameters.

The concept of varying the ratio of the change in foot plate movement to the change in movement of an actuated arm throughout a single stroke, was first introduced by the present inventor in his prior U.S. Pat. No. 4,691,613 for a bass drum pedal. In that patent, the present inventor introduced a generally spiral-shaped torque arm connected to a drive shaft which permitted a constant change in the ratio of the change in foot plate movement to the change in hammer shaft movement. A similar concept was also disclosed in a subsequent patent to Donald Lombari in U.S. Pat. No. 4,756,224.

Even with the improved control provided by the foot pedal of the inventor's prior patent, musicians have still searched for pedals which permit yet more precise control. In terms of a high hat, it would be desirable if the variation in the ratio of the change in foot plate movement to cymbal rod movement could be varied throughout the stroke rather than the constant change disclosed in the Jacobson and Lombari patents. By providing a variable change in this ratio throughout a stroke, a higher total cymbal pressure could be provided while permitting precise control of the movement of the cymbal. Such control would also provide more dynamic foot to cymbal control, a superior field and more effective speed.

The inventor has discovered that the application of two eccentrically mounted sprockets, with one sprocket connected to the foot plate and the second sprocket connected to the cymbal rod provides the desired improved control. The inventor discovered that modification of the twin eccentric sprockets of the return spring of his prior patent, could be applied to a drive shaft to produce the variable change in the ratio desired.

It is therefore an object of the present invention to provide an improved high hat.

Another object is to provide a high hat with a foot pedal in which the ratio of change in foot plate angle per unit of vertical cymbal movement is varied throughout the stroke of the foot pedal.

A further object is to provide a high hat with dynamic foot control and superior speed.

Yet another object of the present invention is to provide a high hat with foot pedal which is simple to operate and refined in appearance.

These and other objects will be apparent to those skilled in the art.

SUMMARY OF THE INVENTION

The high hat of the present invention includes a ground supported stand with a vertical hollow tube through which a cymbal rod is operably mounted. A lower cymbal is mounted on the upper end of the tube with an upper cymbal connected to the upper end of the cymbal rod such that vertical movement of the cymbal rod will cause the upper and lower cymbals to contact one another for a percussive sound. A spring is connected to the cymbal rod to bias the rod into its upper position, wherein the upper cymbal is spaced upwardly away from the lower cymbal. An operable foot pedal is utilized to move the cymbal rod and cause the upper and lower cymbals to contact one another. The foot pedal includes a foot plate pivotally connected at a heel end to a base. A pair of sprockets are connected together and rotatably mounted on a shaft above the toe end of the foot plate. A first chain extends from the toe end of the foot plate and is wrapped partially around the first sprocket on the shaft and is connected thereto so as to cause the sprocket to rotate when the foot plate is depressed. A second drive chain extends from the lower end of the cymbal rod and is wrapped partially around the second sprocket and is connected thereto so as to lower the cymbal rod when the second sprocket is rotated with the first sprocket upon depressing the foot plate. The first and second sprockets are eccentrically mounted on the shaft and offset from one another such that the ratio of vertical cymbal rod movement to pivotal foot plate movement will vary during the stroke of the foot plate.

DESCRIPTION OF THE PREFERRED EMBODIMENT

Figure 2:
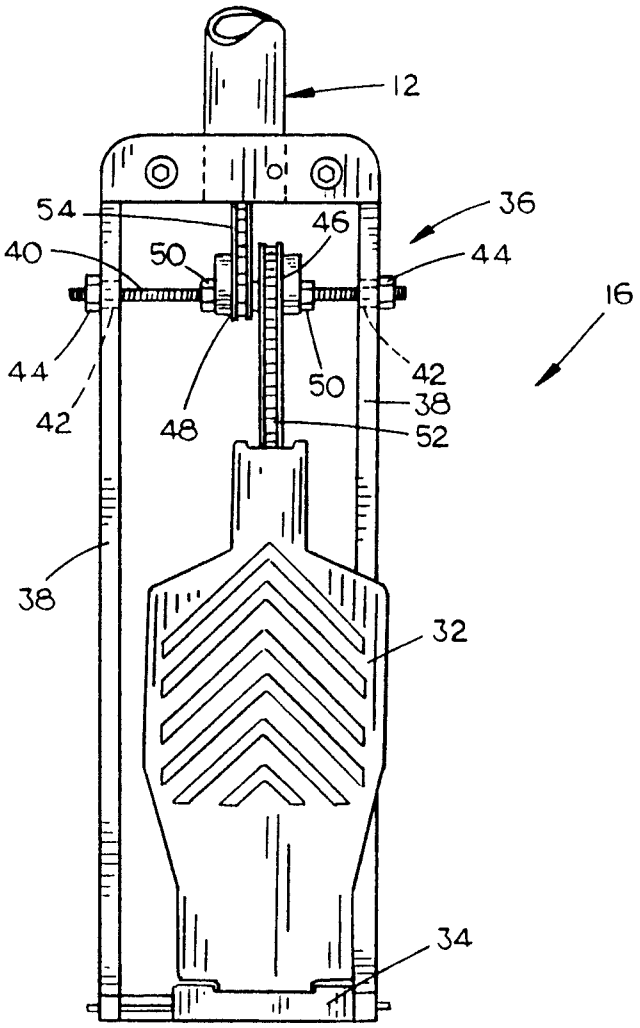
FIG. 2 is an enlarged front view of the foot pedal portion of the invention.
Figure 1:
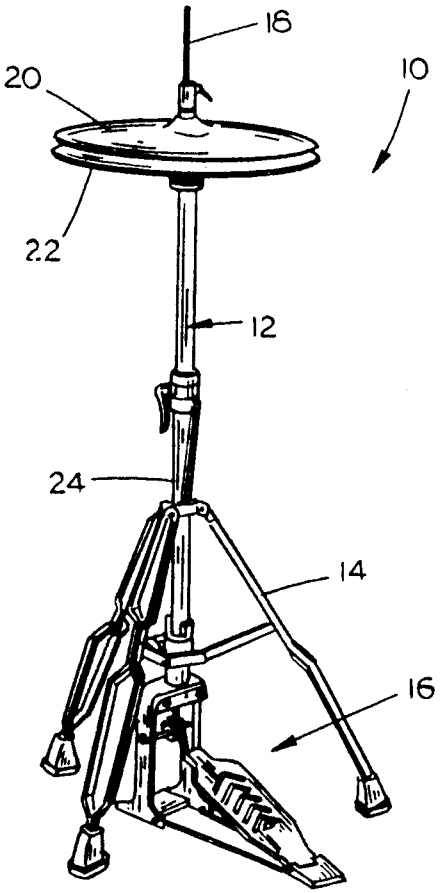
FIG. 1 is a perspective view of the high hat of the present invention.

Referring now to the drawings, in which similar or corresponding parts are identified with the same reference numeral, and more particularly to FIG. 1, the high hat of the present invention is designated generally at 10 and includes a stand 12 supported in an upright position by a retractable tripod 14. A foot pedal 16 is connected to a cymbal rod 18 which extends upwardly through stand 12 with an upper cymbal 20 connected at the upper end thereof. A lower cymbal 22 is connected to the upper end of stand 12 so as to be opposed and spaced apart from upper cymbal 20 when the high hat is in the "at rest" condition.

Figure 4:
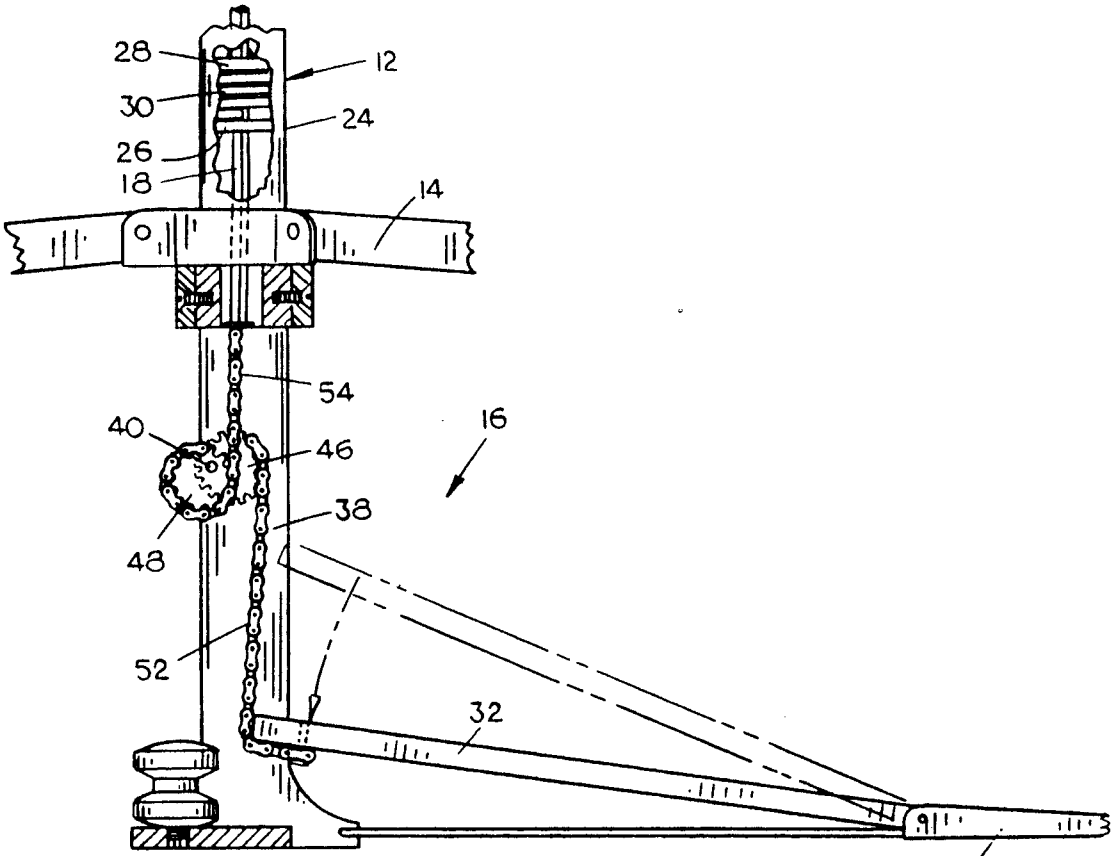
FIG. 4 is a view similar to FIG. 3, with the foot pedal shown in a second position.
Figure 3:
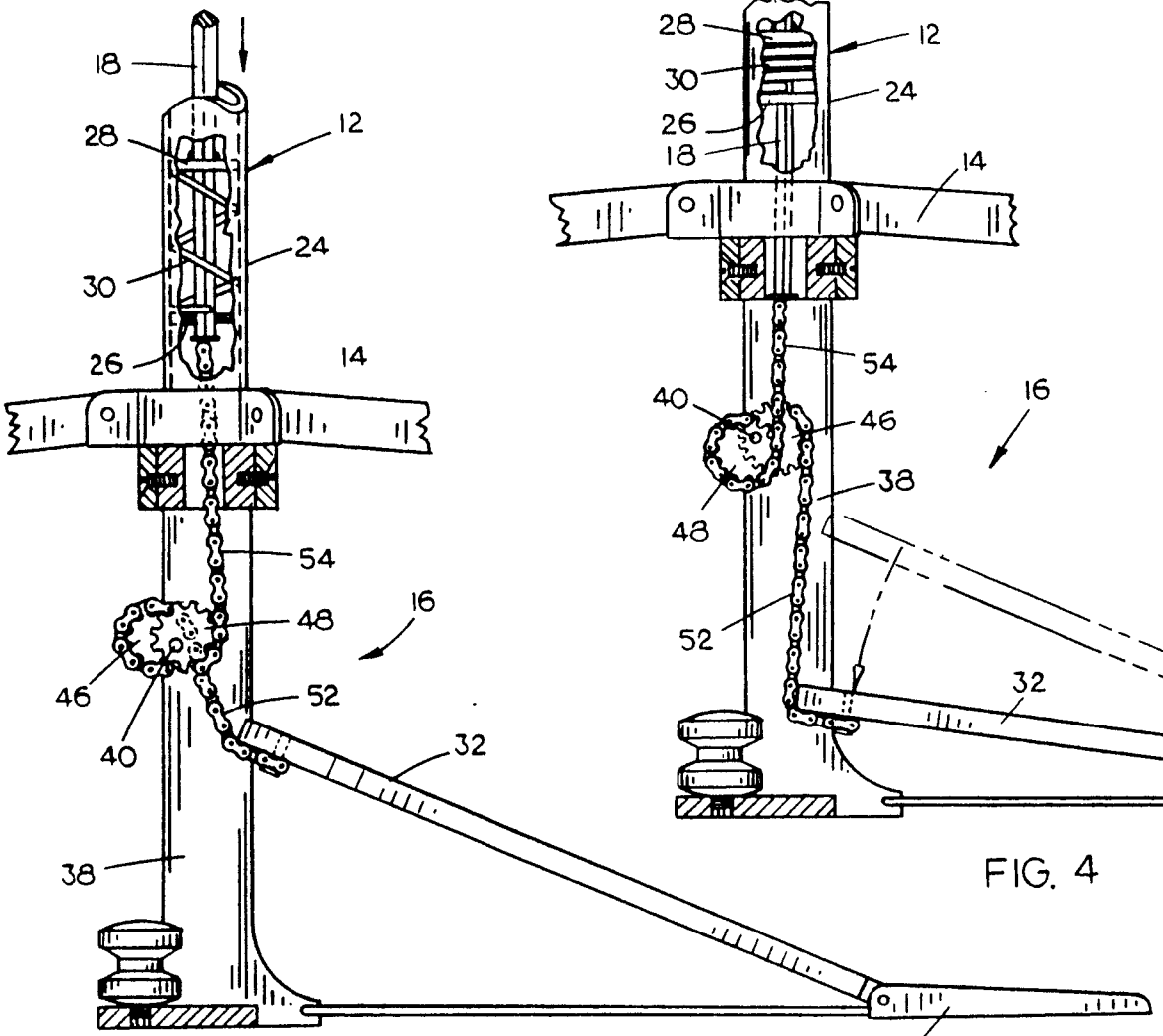
FIG. 3 is a side elevational view taken from the left side of FIG. 2, with portions removed for clarity.
Figure 5:
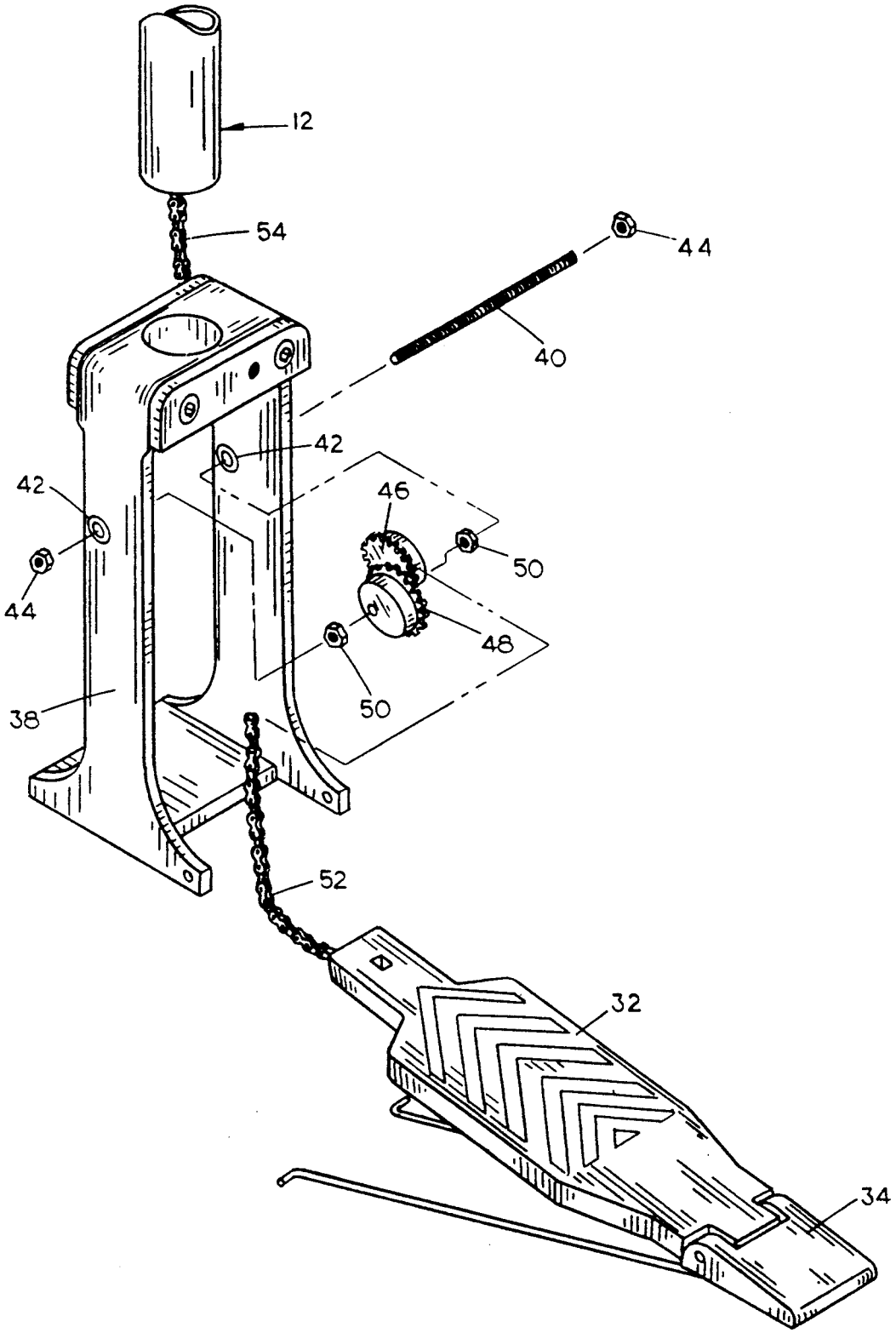
FIG. 5 is an exploded perspective view of the foot pedal of the present invention.

As shown in FIGS. 3 and 4, stand 12 includes a length adjustable vertically oriented hollow tube 24 through which cymbal rod 18 is longitudinally movable. A bearing plate 26 is affixed within the lower end of tube 24, and has an aperture therethrough through which cymbal rod 18 freely passes. A stop plate 28 is mounted to cymbal rod 18 above its lower end, and serves to retain a spring 30 between bearing plate 26 and stop plate 28. In this fashion, cymbal rod 18 will be biased upwardly by spring 30.

Referring now to FIGS. 2-5, foot pedal 16 includes a foot plate 32 pivotally mounted at a heel end to a base 34. The toe end of foot plate 32 is connected to cymbal rod 18 via a variable drive mechanism designated generally at 36. Variable drive mechanism 36 permits the ratio of foot plate pivotal movement to cymbal rod vertical movement to be varied throughout the stroke of the foot plate. Variable drive mechanism 36 is operably mounted between a pair of uprights 38 extending upwardly from base 34 and connected at their upper ends to stand 12

Variable drive mechanism 36 includes a shaft 40 rotatably mounted between a pair of bearings 42 and uprights 38. A pair of lock nuts 44, or the like, maintain the rotatable position of shaft 40 between the uprights. A foot plate sprocket 46 and a cymbal rod sprocket 48 are mounted adjacent and spaced apart one another on shaft 40 with the sprockets line in parallel planes. Sprockets 46 and 48 are locked together using lock nuts 50 such that they rotate together on drive shaft 40. A first drive chain 52 has one end connected to the toe end of foot plate 32 and the other end wrapped over the top of foot plate sprocket 46 and connected to the peripheral edge thereof. First drive chain 52 extends around foot plate sprocket 46 a distance at least as great as the distance which the toe end of foot plate 32 travels from its initial rest position to its maximum depressed position. In this way, depressing foot plate 32 will continuously rotate foot plate sprocket 46 on drive shaft 40.

A second drive chain 54 has one end connected to the lower end of cymbal rod 18, and the other end wrapped around and connected to the peripheral edge of cymbal rod sprocket 48. First drive chain 52 and second drive chain 54 are wrapped around their corresponding sprockets 46 and 48 such that one drive chain is being unwrapped from its sprocket while the other drive chain is being wrapped around its associated sprocket as the sprockets rotate on drive shaft 40.

Figure 6:
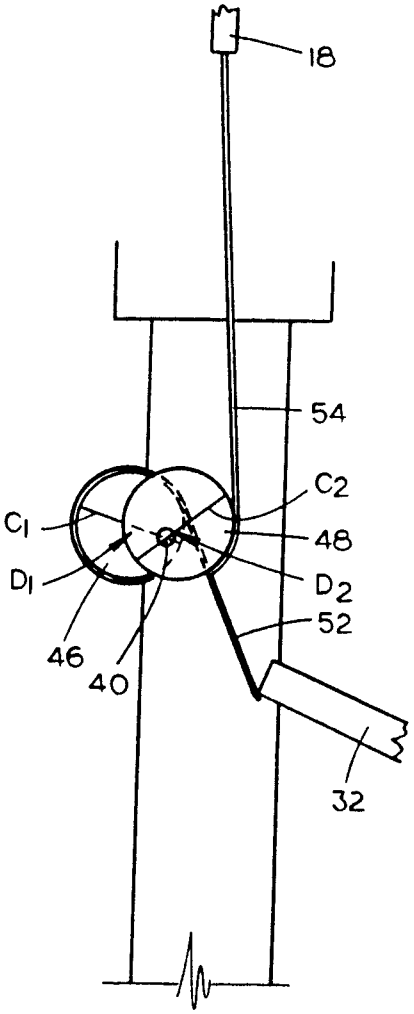
FIG. 6 is a schematic view of the cam drive apparatus of the present invention at a start position.

Referring now to FIG. 6, sprockets 46 and 48 and drive chains 52 and 54 are shown in schematic form attached between foot plate 32 and cymbal rod 18 respectively. As shown in FIG. 6, foot plate sprocket 46 and cymbal rod sprocket 48 are eccentrically mounted on drive shaft 40. Preferably, foot plate sprocket 46 is mounted at a point approximately one fourth of its diameter D1 and cymbal rod sprocket 48 is mounted at a point approximately one third of its diameter D2 on drive shaft 40. The longer portion of each diameter of sprockets 46 and 48 extending through drive shaft 40 are designated as C1 and C2, respectively. In the preferred embodiment, maximum diameters C1 and C2 are set at an angle of approximately 125° with respect to one another on drive shaft 40. Of course, the sprockets may be eccentrically mounted in a variety of positions, and at a variety of angles with respect to their maximum diameters, to achieve similar results. In the example shown in the drawings, a full stroke of foot plate 32 from the position shown in FIG. 6 to the solid line position of FIG. 10 will rotate sprockets 46 and 48 approximately 170° on drive shaft 40. FIGS. 7-10 show the sprockets 46 and 48 rotated through one fourth of the 170° full rotation of the sprockets, and also the approximate distance traveled of foot plate 32 and cymbal rod 18.

Figure 8:
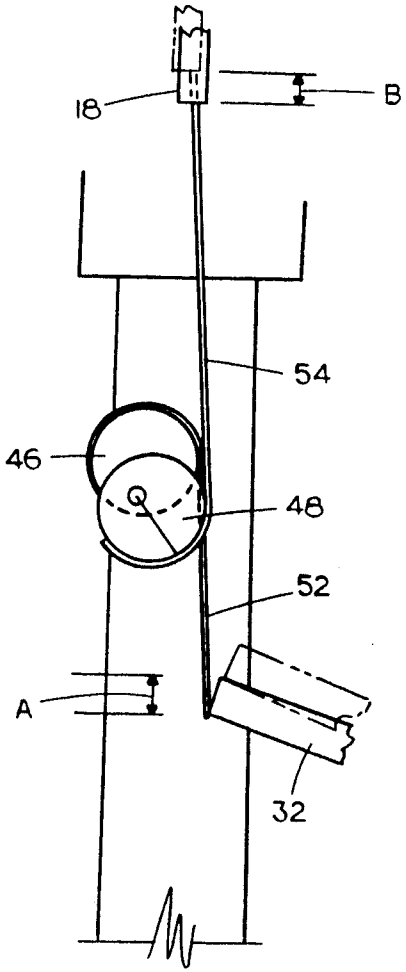
FIG. 8 is a view similar to FIG. 6 with the cam drive apparatus moved to a position one half of its full rotation.
Figure 7:
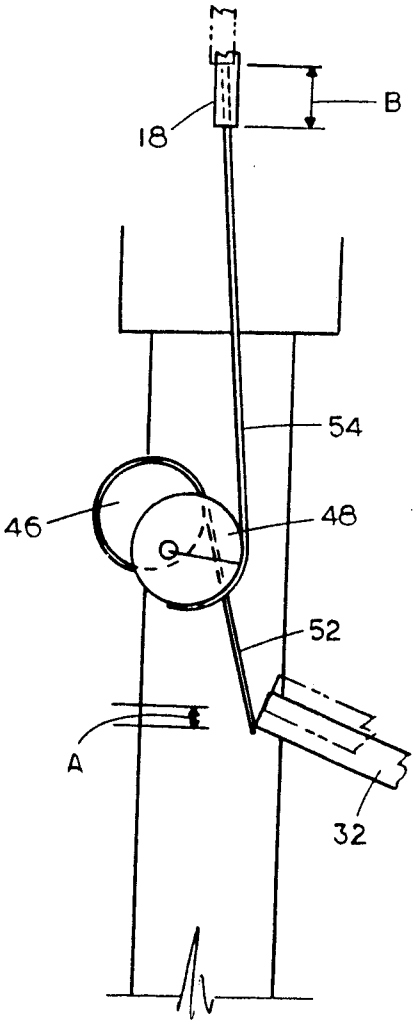
FIG. 7 is a view similar to FIG. 6 with the cam drive apparatus shown moved to a position one quarter of the maximum rotation.
Figure 10:
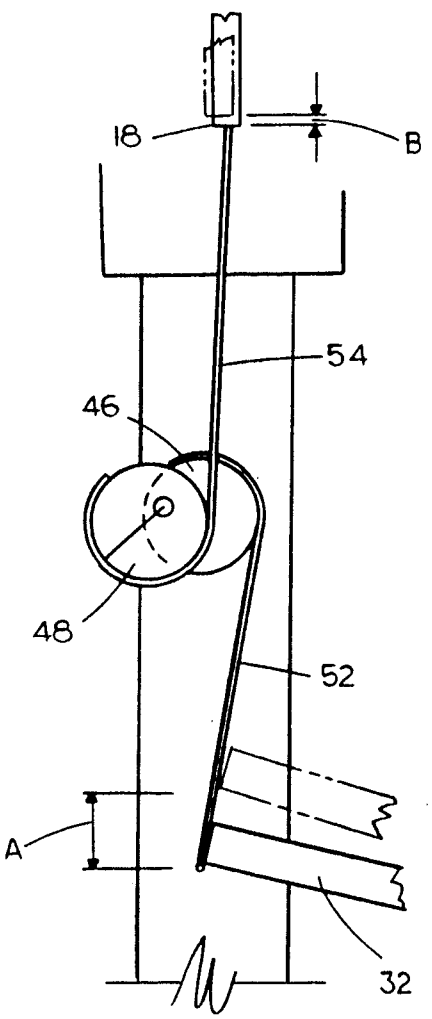
FIG. 10 is a view similar to FIG. 6 with the cam drive apparatus moved to its maximum rotated position.
Figure 9:
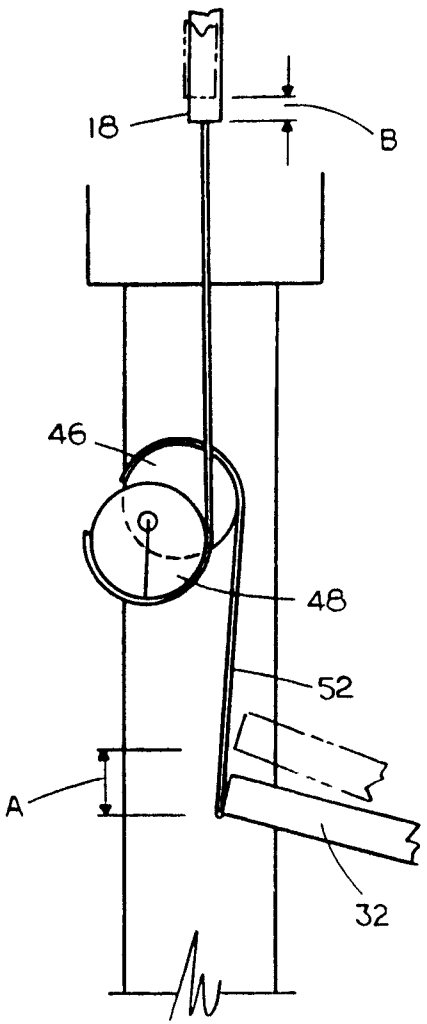
FIG. 9 is a view similar to FIG. 6 with the cam drive apparatus shown moved to a position three quarters of its maximum rotation.

FIG. 7 shows the initial position of foot plate 32 and cymbal rod 18 in broken lines, with the new position in solid lines after one quarter of the full rotation of sprockets 46 and 48 has occurred. In this first quarter rotation, foot plate 32 has pivoted a distance indicated at A, and cymbal rod 18 is moved a distance indicated at B. It can therefore be seen that at the beginning of a foot plate stroke, a very small amount of pivotal movement of the foot plate will cause a large vertical movement of cymbal rod 18. In the second quarter rotation of sprockets 46 and 48, as shown in FIG. 8, the sprockets are oriented such that the amount of foot plate movement A has increased, while the amount of vertical cymbal rod movement B has decreased. FIGS. 9 and 10 show sprockets 46 and 48 rotated to the three quarter position and then the maximum rotation position, respectively. Comparing the movements of foot plate 32 and cymbal rod 18, it can be seen that foot plate movement A increases to its maximum amount per unit of rotation of sprockets 46 and 48 at the end of the foot plate stroke. The movement B of cymbal rod 18 is large at the beginning of the foot plate stroke and steadily decreases per unit of rotation of sprockets 46 and 48 until reaching a minimum amount of movement near the end of the stroke. This variably changing ratio permits a quicker movement of upper cymbal 20 at the beginning of the foot plate stroke. A larger amount of foot plate movement with respect to cymbal rod movement at the end of the foot plate stroke enhances the amount of control in the last quarter of the foot plate stroke.

This permits very quick and precise playing times and a higher pressure of cymbal contact.

Whereas the invention has been shown and described in connection with the preferred embodiment thereof, it will be understood that many modifications, substitutions and additions may be made which are within the intended broad scope of the appended claims. There has therefore been shown and described an improved high hat which accomplishes at least all of the above stated objects.

I claim:

1. A high hat, comprising:

a ground support stand having a generally vertical hollow tube with upper and lower ends;

a cymbal rod operably mounted for vertical movement within said tube;

a lower cymbal connected to the upper end of said tube;

said cymbal rod having an upper end projecting through an aperture in said lower cymbal;

an upper cymbal connected to the upper end of said cymbal rod for movement therewith;

said cymbal rod operable between an upper position wherein said upper cymbal is spaced upwardly away from said lower cymbal, and a lower position wherein said upper cymbal is in contact with said lower cymbal;

an operable foot pedal operably connected to said cymbal rod to move the cymbal rod between its upper and lower positions;

biasing means for biasing said cymbal rod to its upper position;

said foot pedal including:

a foot plate having a toe end and a heel end, pivotally connected at its heel end to a base;

a variable drive assembly connecting said toe end of said foot plate to the lower end of said cymbal rod for vertically moving the cymbal rod when the foot pedal is pivoted;

said variable drive assembly including means for varying the ratio of vertical cymbal movement to pivotal foot plate movement during a stroke of the foot plate from an upper "at rest" position wherein said cymbal rod is in its upper position, and a lower "depressed" position wherein said cymbal rod is in its lower position;

said means for varying the ratio of vertical cymbal rod movement to pivotal foot plate movement including:

a shaft connected to said high hat stand, oriented generally perpendicularly to the cymbal rod and generally parallel to the pivotal axis of the foot plate;

a first sprocket means rotatably mounted on said shaft;

a first drive chain means connected at one end to the toe end of said foot plate, wrapped partially around said first sprocket and connected thereto so as to rotate said first sprocket about said shaft in a first direction when the foot plate is depressed;

a second sprocket means rotatably mounted on said shaft and connected to said first sprocket means for rotation therewith;

a second drive chain means connected at one end to the lower end of said cymbal rod, wrapped at least partially around said second sprocket and connected thereto so as to lower said cymbal rod when said second sprocket is rotated in said first direction;

said first and second sprockets being eccentrically mounted on said shaft to vary the velocity of rotation of said sprockets with respect to the pivotal movement of the foot plate;

said first and second sprockets being offset with respect to one another such that the amount of movement of the cymbal rod is large with respect to the movement of the foot plate at the beginning of a stroke, such that the amount of movement of the cymbal rod is small with respect to the movement of the foot plate at the end of a stroke, and such that the rate of change in movement of the cymbal rod varies throughout the stroke.

2. A foot pedal for a musical instrument of the type having a rod operable to move a sound-producing apparatus, comprising:

a foot plate having a toe end and a heel end, pivotally connected at its heel end to a base;

a variable drive assembly connecting said toe end of said foot plate to the lower end of said cymbal rod for vertically moving the cymbal rod when the foot pedal is pivoted between an upper "at rest" position, wherein the cymbal rod is in its upper position, and a lower "depressed" position, wherein said cymbal rod is in its lower position;

said variable drive assembly including:

a shaft connected to said high hat stand, oriented generally perpendicularly to the cymbal rod and generally parallel to the pivotal axis of the foot plate;

a first sprocket means rotatably mounted on said shaft;

a first drive chain means connected at one end to the toe end of said foot plate, wrapped partially around said first sprocket and connected thereto so as to rotate said first sprocket about said shaft in a first direction when the foot plate is depressed;

a second sprocket means rotatably mounted on said shaft and connected to said first sprocket means for rotation therewith;

a second drive chain means connected at one end to the lower end of said cymbal rod, wrapped at least partially around said second sprocket and connected thereto so as to lower said cymbal rod when said second sprocket is rotated in said first direction;

said first sprocket being eccentrically mounted on said shaft to produce a constant change in the ratio of the velocity of rotation of both said sprockets with respect to the pivotal movement of the foot plate;

said second sprocket being eccentrically mounted on said shaft and offset with respect to said first sprocket, to produce a variable change in the ratio of the velocity of rotation of the sprockets with respect to the pivotable movement of the foot plate throughout a single stroke.

* * * * *